US009429115B2

(12) United States Patent
Yamanari

(10) Patent No.: US 9,429,115 B2
(45) Date of Patent: Aug. 30, 2016

(54) INTAKE MANIFOLD

(71) Applicant: TOYOTA JIDOSHA KABUSHIKI KAISHA, Toyota-shi, Aichi-ken (JP)

(72) Inventor: Kenji Yamanari, Kariya (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/439,590

(22) PCT Filed: Sep. 2, 2013

(86) PCT No.: PCT/JP2013/005170
§ 371 (c)(1),
(2) Date: Apr. 29, 2015

(87) PCT Pub. No.: WO2014/068824
PCT Pub. Date: May 8, 2014

(65) Prior Publication Data

US 2015/0285196 A1 Oct. 8, 2015

(30) Foreign Application Priority Data

Oct. 31, 2012 (JP) ..... 2012-240516

(51) Int. Cl.
*F02M 35/10* (2006.01)
*F02M 35/112* (2006.01)

(52) U.S. Cl.
CPC . *F02M 35/10078* (2013.01); *F02M 35/10216* (2013.01); *F02M 35/1036* (2013.01); *F02M 35/112* (2013.01); *F02M 2200/185* (2013.01)

(58) Field of Classification Search
CPC ..... F02M 35/112; F02M 35/116; F02M 35/10052; F02M 35/10072; F02M 35/10321; F02M 35/10144; F02M 35/10216; F02M 35/10347; F02M 35/10354; F02M 35/10045; F02M 35/104; F02M 35/108; F02M 35/1036
USPC ..... 123/184.21, 184.24, 184.34, 184.38, 123/184.39, 184.41, 184.42, 184.43, 123/184.44, 184.45
See application file for complete search history.

(56) References Cited

U.S. PATENT DOCUMENTS 6,371,070 B2 * 4/2002 Munetoki ..... 123/184.42
7,270,102 B2 * 9/2007 Tanikawa ..... B29C 65/06 123/184.42
7,451,732 B1 * 11/2008 Vichinsky ..... F02M 25/089 123/184.42

(Continued)

FOREIGN PATENT DOCUMENTS

JP 2006291915 A 10/2006
JP 2009-236018 A 10/2009
JP 2010-234567 A 10/2010

OTHER PUBLICATIONS

Toyota Gijutsukokaishu No. JP19559, dated Sep. 30, 2008, 1 page. Comments: A welded portion between an intake manifold upper portion and an intake manifold middle portion is set to a portion offset from a lower portion of a fuel delivery pipe.

*Primary Examiner* — Sizo Vilakazi
(74) *Attorney, Agent, or Firm* — Kenyon & Kenyon LLP

(57) ABSTRACT

The invention addresses a challenge for providing an intake manifold that is able to suppress interference of the intake manifold with fuel injection valves at the time of a collision of a vehicle. In an intake manifold, joint faces and joint portions are connected to each other such that lines extended from the joint faces of flange portions and joint faces of the joint portions are oriented toward positions clear of fuel injection valves. In the intake manifold, each joint portion is formed such that a length of the joint face in a direction in which the joint face extends is longer than a maximum spaced distance between the corresponding fuel injection valve and the corresponding flange portion.

3 Claims, 16 Drawing Sheets

(56) References Cited

U.S. PATENT DOCUMENTS 8,365,695 B2 * 2/2013 Wakamatsu ..... F02M 35/10085 123/184.21
2002/0046725 A1 * 4/2002 Ogata ..... B29C 65/06 123/184.61
2003/0140883 A1 * 7/2003 Kemper ..... F02M 35/10045 123/184.61
2009/0241886 A1 * 10/2009 Kameda ..... F02M 35/10144 123/184.21
2013/0199486 A1 * 8/2013 Yano ..... F02M 35/104 123/184.21

* cited by examiner ( a )

( b )

( a )

( b )

( )a ( b )

(a)

(b)

( a )

( b )

(a)

(b)

INTAKE MANIFOLD

CROSS-REFERENCE TO RELATED APPLICATIONS

This is a national phase application based on the PCT International Patent Application No. PCT/JP2013/005170 filed Sep. 2, 2013, claiming priority to Japanese Patent Application No. 2012-240516 filed Oct. 31, 2012, the entire contents of both of which are incorporated herein by reference.

TECHNICAL FIELD

The invention relates to an intake manifold and, more particularly, to an intake manifold that is connected to an internal combustion engine and that introduces intake air into each of cylinders of the internal combustion engine.

BACKGROUND ART

An intake manifold is connected to an internal combustion engine mounted on a vehicle. The intake manifold includes a surge tank and intake branch pipes. The intake branch pipes distribute intake air to cylinders of the internal combustion engine. Because the intake manifold has a complex shape, the intake manifold is formed of a plurality of split pieces that are connected to each other via joint faces.

Fuel injection valves are provided in the internal combustion engine. It is required to suppress a collision of the intake manifold with the fuel injection valves at the time of a collision of the vehicle.

As a technique for suppressing a collision of an intake manifold with fuel-system components, there is a technique that the distance between a delivery pipe and a position at which an intake manifold upper of an intake manifold and an intake manifold middle of the intake manifold are welded to each other is ensured at or above a predetermined distance a (for example, see Patent Document 1). This intake manifold is able to prevent damage to the delivery pipe due to a broken piece of the intake manifold when the intake manifold is damaged at the time of a collision of a vehicle.

RELATED ART DOCUMENT

Patent Document

Patent Document 1: Japanese Patent Application Publication No. 2009-236018 (JP 2009-236018 A)

SUMMARY OF THE INVENTION

Problem to be Solved by the Invention

However, in such an existing intake manifold, if the intake manifold upper slides toward the delivery pipe with respect to the intake manifold middle at the time of a collision of the vehicle, the distal end of the intake manifold upper enters the space between the internal combustion engine and the fuel injection valves connected to the delivery pipe.

Generally, the delivery pipe is provided so as to extend in the crank axis direction of the internal combustion engine; whereas each of the fuel injection valves has a cylindrical shape and is provided for each cylinder of the internal combustion engine, and has a lower strength than the delivery pipe. Therefore, if the distal end of the intake manifold upper enters the space on the lower sides of the fuel injection valves connected to the delivery pipe, there is a concern that the distal end of the intake manifold upper interferes with the fuel injection valves.

The invention is contemplated to solve the above-described existing problem, and it is an object of the invention to provide an intake manifold that is able to suppress interference of the intake manifold with fuel injection valves at the time of a collision of a vehicle.

Means for Solving the Problem

In order to achieve the above object, an intake manifold according to the invention is mounted on an internal combustion engine in which fuel injection valves are installed so as to be located near one side face of a cylinder head on a top face of the cylinder head, and the intake manifold is connected to the one side face of the cylinder head so as to face the fuel injection valves. In the intake manifold, a plurality of intake branch pipes made of resin are provided, the plurality of intake branch pipes introduce intake air into corresponding intake ports of the cylinder head, each of the intake branch pipes is split into a first split branch pipe and a second split branch pipe that is connected to the first split branch pipe, a flange portion is formed at a distal end of each first split branch pipe, each flange portion has a contact face at one side face and a first joint face at the other side face, the contact face contacts the cylinder head, each flange portion is connected to the cylinder head, a joint portion is formed at a distal end of each second split branch pipe, each joint portion has a second joint face that is connected to a corresponding one of the first joint faces, the flange portions and the joint portions are connected to the cylinder head such that lines extended from the first joint faces and the second joint faces are oriented toward positions clear of the fuel injection valves, and each joint portion is formed such that a length of the second joint face in a direction in which the second joint face extends is longer than a maximum spaced distance between the corresponding fuel injection valve and the corresponding flange portion.

In this intake manifold, the flange portions and the joint portions are connected to the cylinder head such that the lines extended from the first joint faces of the flange portions of the first split branch pipes and the second joint faces of the joint portions of the second split branch pipes are oriented toward the positions clear of the fuel injection valves. Therefore, when the joint portions of the second split branch pipes slide upward with respect to the flange portions of the first split branch pipes because of the behavior of the intake manifold at the time of a collision of the vehicle, the joint portions of the second split branch pipes do not directly collide with the fuel injection valves.

Each joint portion is formed such that the length of the second joint face of the joint portion in the direction in which the second joint face extends is longer than the maximum spaced distance between the corresponding fuel injection valve and the corresponding flange portion. Thus, it is possible to prevent each of the joint portions of the second split branch pipes from entering the space between the corresponding flange portion of the first split branch pipe and the corresponding fuel injection valve. Therefore, it is possible to reliably suppress a collision of each of the joint portions of the second split branch pipes with the corresponding fuel injection valve. As a result, it is possible to suppress interference of the intake manifold with the fuel injection valves.

Preferably, the first joint faces and the second joint faces are formed in a linear shape.

In this intake manifold, the first joint faces and the second joint faces are formed in a linear shape. Therefore, when the joint portions of the second split branch pipes slide upward with respect to the flange portions of the first split branch pipes because of the behavior of the intake manifold at the time of a collision of the vehicle, it is possible to suppress a direct collision of the joint portions of the second split branch pipes with the fuel injection valves.

More preferably, each flange portion is connected to the cylinder head so as to face the corresponding fuel injection valve on a lower side of the corresponding fuel injection valve.

In this intake manifold, each flange portion is connected to the cylinder head so as to face the corresponding fuel injection valve on the lower side of the corresponding fuel injection valve. Thus, it is possible to connect the flange portions and the joint portions to each other such that the lines extended from the first joint faces and the second joint faces are oriented toward the positions clear of the fuel injection valves. Therefore, when the joint portions of the second split branch pipes slide upward with respect to the flange portions of the first split branch pipes because of the behavior of the intake manifold at the time of a collision of the vehicle, it is possible to suppress a direct collision of the joint portions of the second split branch pipes with the fuel injection valves.

Advantageous Effect of the Invention

According to the invention, it is possible to provide an intake manifold that is able to suppress interference of the intake manifold with fuel injection valves at the time of a collision of a vehicle.

MODES FOR CARRYING OUT THE INVENTION

Hereinafter, an embodiment of an intake manifold according to the invention will be described with reference to the accompanying drawings.

FIG. 1 to FIG. 16 show the embodiment of the intake manifold according to the invention. Initially, a configuration will be described.

Figure 1:
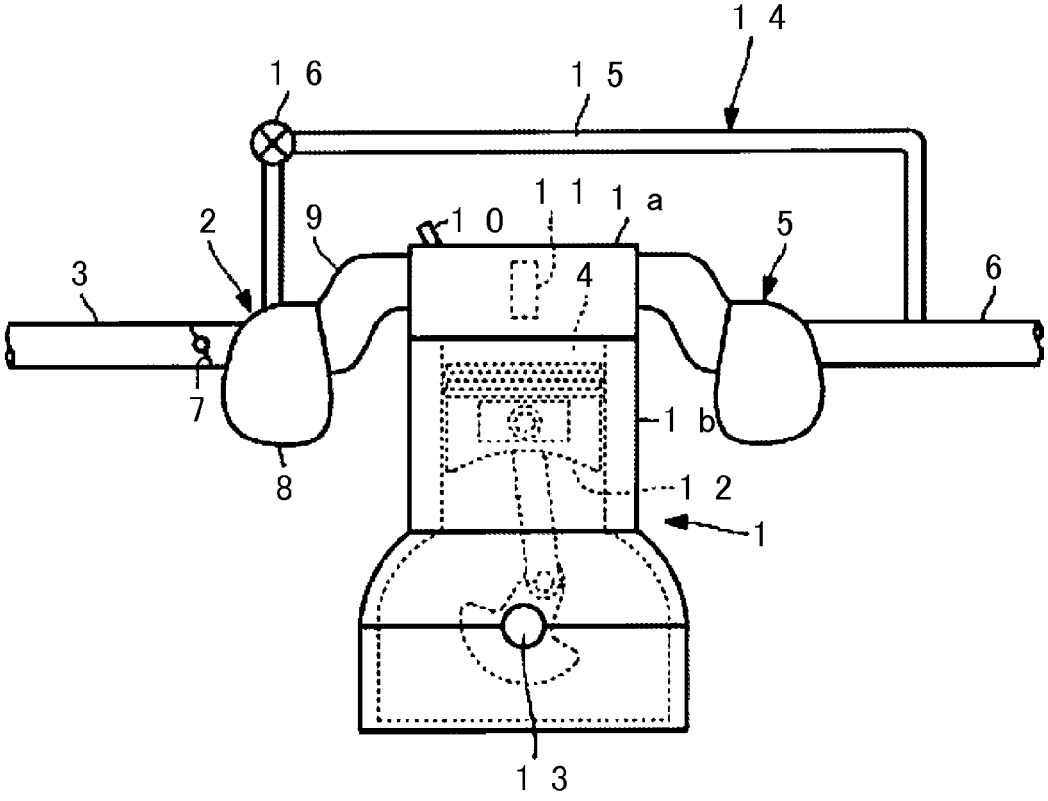
FIG. 1 is a view that shows an embodiment of an intake manifold according to the invention and is a schematic configuration view of an internal combustion engine including an intake manifold.

In FIG. 1, an engine 1 that is an internal combustion engine includes a cylinder head 1*a* and a cylinder block 1*b*, and an intake manifold 2 made of resin is connected to the cylinder head 1*a*.

The intake manifold 2 mounted on the engine 1 introduces outside air and distributes outside air to combustion chambers 4 of cylinders via intake ports. Outside air is introduced through an intake pipe 3 from an air duct (not shown). The intake ports are formed in the cylinder head 1*a*. The cylinders are formed in the cylinder block 1*b*.

An exhaust manifold 5 is connected to the cylinder head 1*a*. The exhaust manifold 5 collects exhaust gas and emits the exhaust gas to an exhaust pipe 6. Exhaust gas is emitted from the combustion chambers 4 of the cylinders of the engine 1.

A throttle valve 7 is provided in the intake pipe 3. The throttle valve 7 adjusts the amount of intake air that is introduced into the combustion chambers 4. The intake manifold 2 includes a surge tank 8 and intake branch pipes 9. The surge tank 8 is connected to the intake pipe 3. The intake branch pipes 9 are branched from the surge tank 8 and have delivery passages that communicate with the combustion chambers of the engine 1.

The number of the intake branch pipes 9 depends on the number of the cylinders of the engine 1. The intake manifold 2 according to the present embodiment is applied to a four-cylinder engine, so the number of the intake branch pipes 9 is four. However, the number of the cylinders of the engine 1 is not specifically limited to four.

Fuel injection valves 10 are connected to the top of the cylinder head 1*a* on the upper side of the intake branch pipes 9. Each fuel injection valve 10 injects fuel into a corresponding one of the combustion chambers 4 through the corresponding intake port formed in the cylinder head 1*a*.

When fuel is injected from any one of the fuel injection valves 10 into a corresponding one of the combustion chambers 4, air-fuel mixture is filled inside the corresponding combustion chamber 4, and the air-fuel mixture is combusted by ignition of an ignition plug 11. Air-fuel mixture is composed of fuel and air that is introduced from the delivery passage of the corresponding intake branch pipe 9. The ignition plug 11 is provided for each cylinder.

A corresponding piston 12 reciprocates on combustion energy at this time. The reciprocation of the piston 12 is converted to the rotational motion of a crankshaft 13 of the engine 1. The engine 1 is provided with an EGR mechanism 14 for reducing the amount of nitrogen oxides (NOx) contained in exhaust gas. The EGR mechanism 14 returns part of exhaust gas, emitted to the exhaust pipe 6, to the intake manifold 2.

The EGR mechanism 14 includes an EGR pipe 15 and an EGR valve 16. The EGR pipe 15 connects the exhaust pipe 6 to the intake manifold 2. The EGR valve 16 adjusts the flow rate of EGR gas, which is returned from the exhaust pipe 6 to the intake manifold 2, by changing an opening degree inside the EGR pipe 15.

The EGR mechanism 14 reduces production of NOx by reducing the combustion temperature of air-fuel mixture inside the combustion chambers 4 through returning part of exhaust gas of the engine 1 to the intake manifold 2. Thus, the EGR mechanism 14 is able to reduce the amount of NOx contained in exhaust gas of the engine 1.

Figure 2:
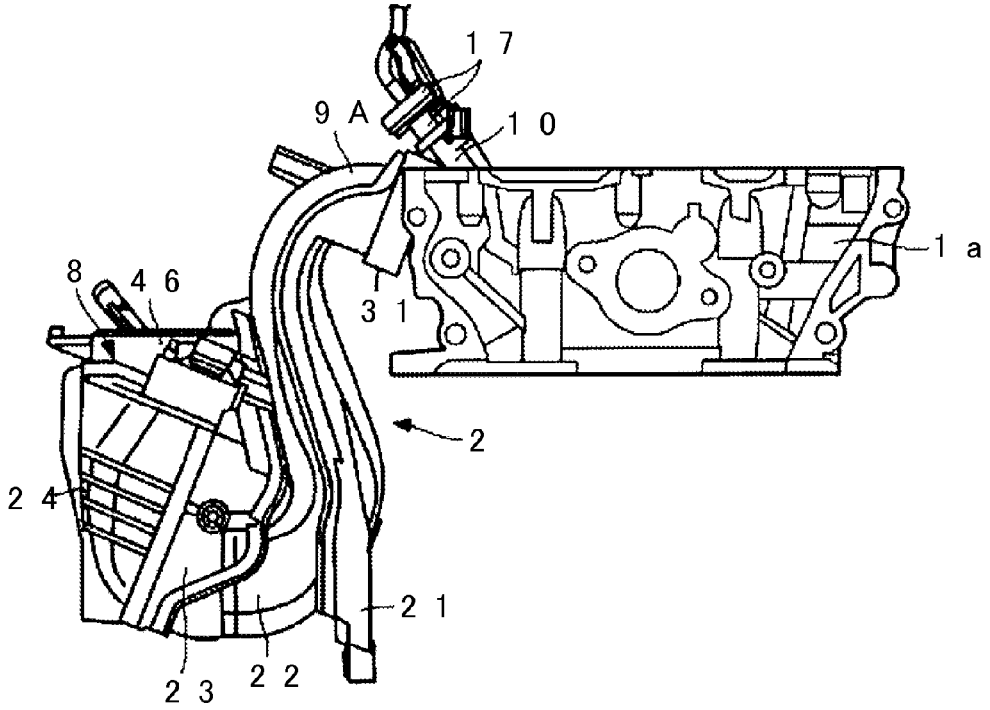
FIG. 2 is a view that shows the embodiment of the intake manifold according to the invention and is a side view of the intake manifold connected to a cylinder head.
Figure 3:
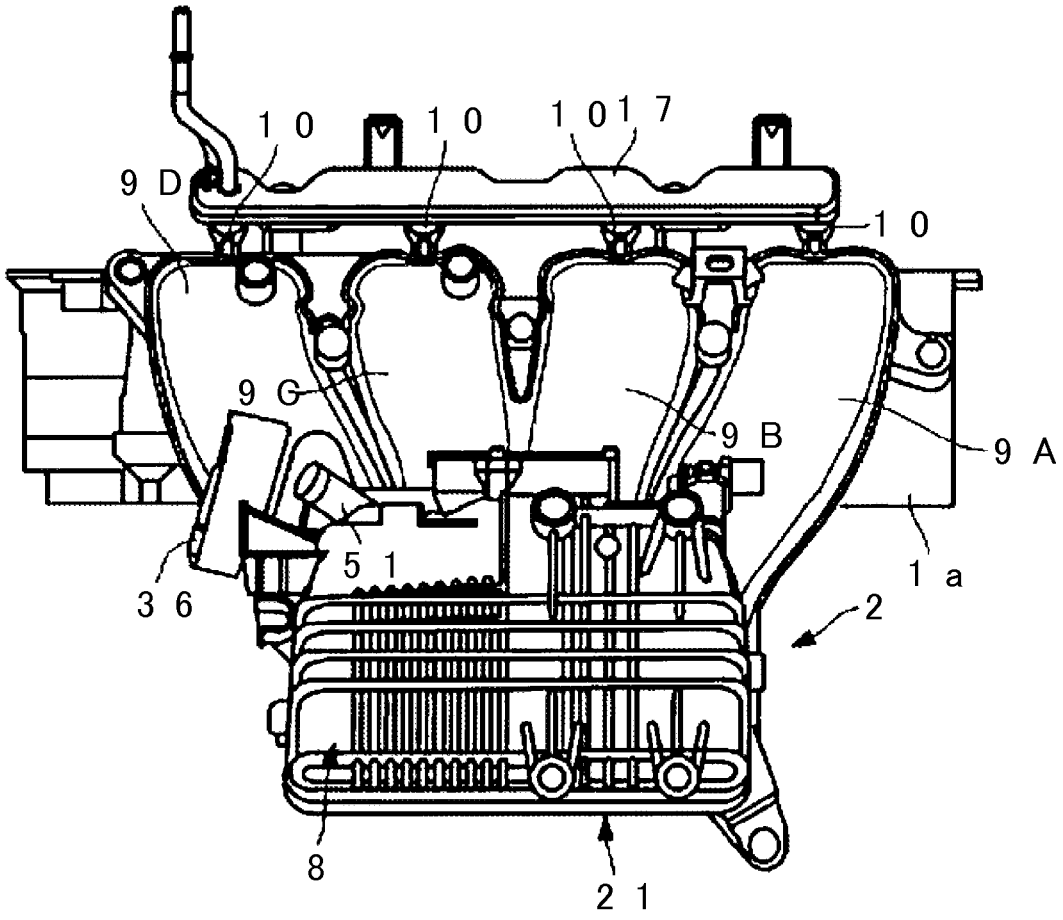
FIG. 3 is a view that shows the embodiment of the intake manifold according to the invention and is a rear view of the intake manifold connected to the cylinder head.

As shown in FIG. 2 and FIG. 3, a delivery pipe 17 made of metal is provided above the cylinder head 1*a*. The delivery pipe 17 extends in the axial direction of the crankshaft 13, that is, the crank axis direction, and is installed near one side face of the cylinder head 1*a* above the top face of the cylinder head 1*a*.

The fuel injection valves 10 provided respectively for the cylinders are connected to the delivery pipe 17. The fuel injection valves 10 are installed so as to be located near the one side face of the cylinder head 1*a* on the top face of the cylinder head 1*a*. Fuel is supplied from the delivery pipe 17 to the fuel injection valves 10.

Figure 4:
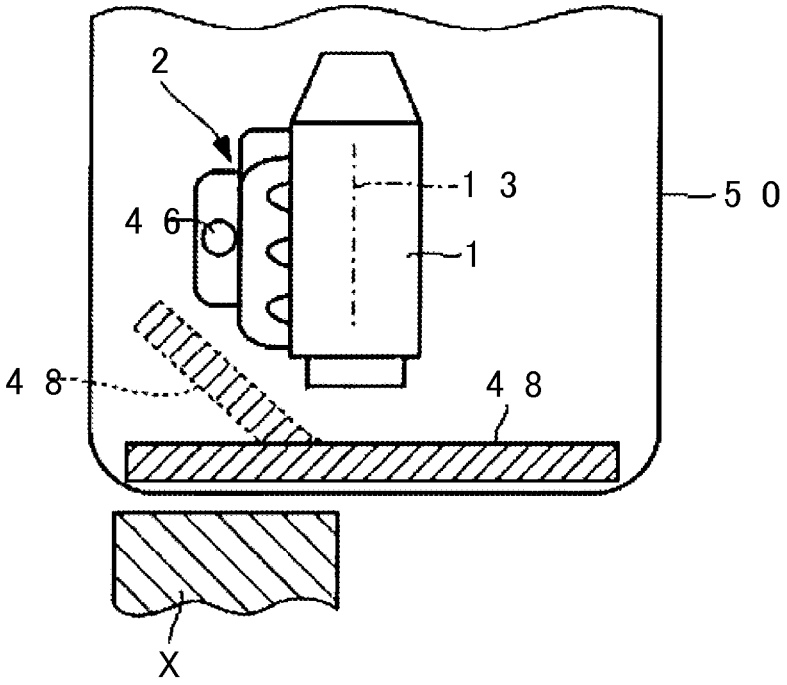
FIG. 4 is a view that shows the embodiment of the intake manifold according to the invention and is a view that shows a vehicle-mounted state of the engine and intake manifold.
Figure 5:
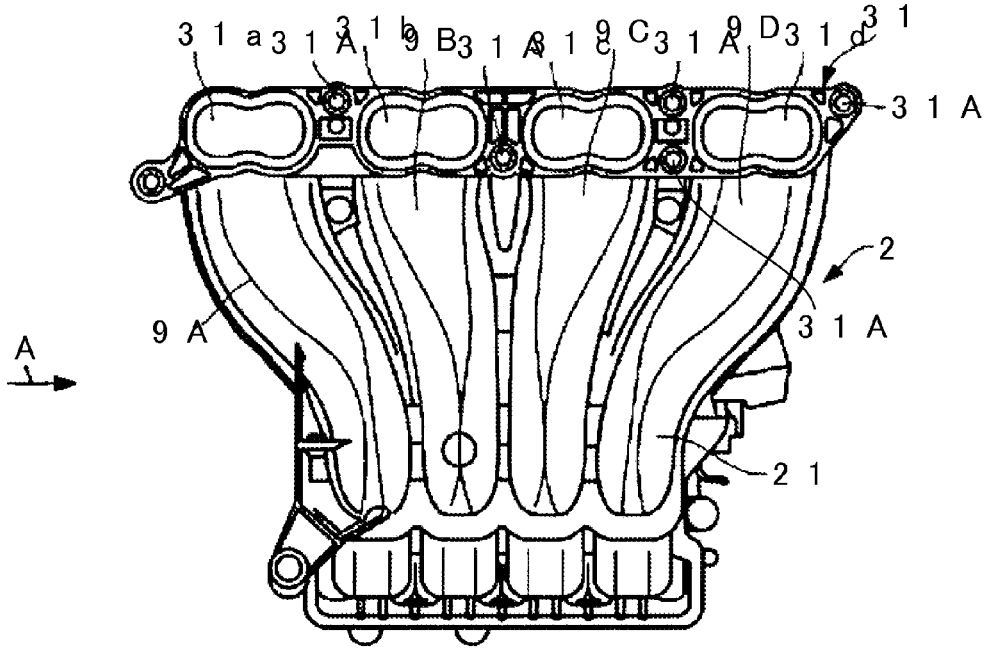
FIG. 5 is a view that shows the embodiment of the intake manifold according to the invention, in which FIG. 5(*a*) is a front view of the intake manifold and FIG. 5(*b*) is a side view of FIG. 5(*a*) in the direction of A.
Figure 5:
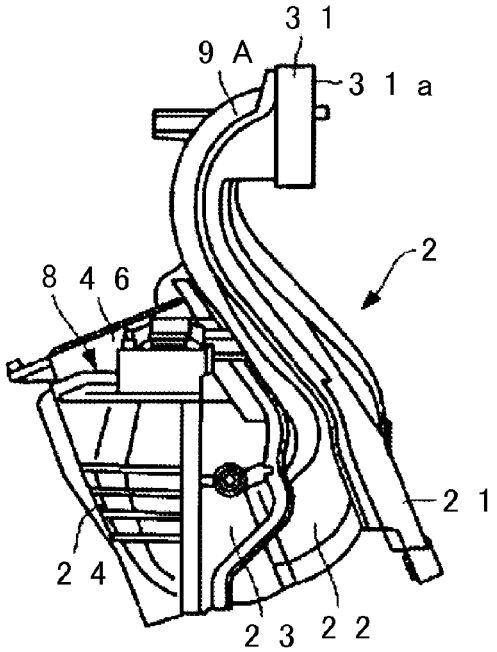
Figure 6:
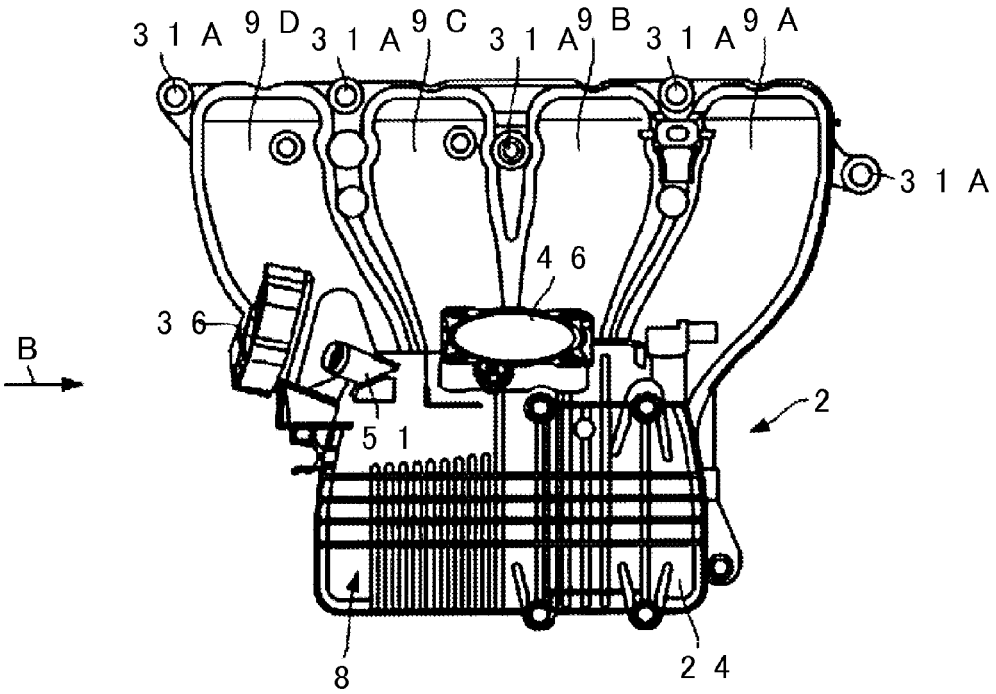
FIG. 6 is a view that shows the embodiment of the intake manifold according to the invention, in which FIG. 6(*a*) is a rear view of the intake manifold and FIG. 6(*b*) is a side view of FIG. 6(*a*) in the direction of B.
Figure 6:
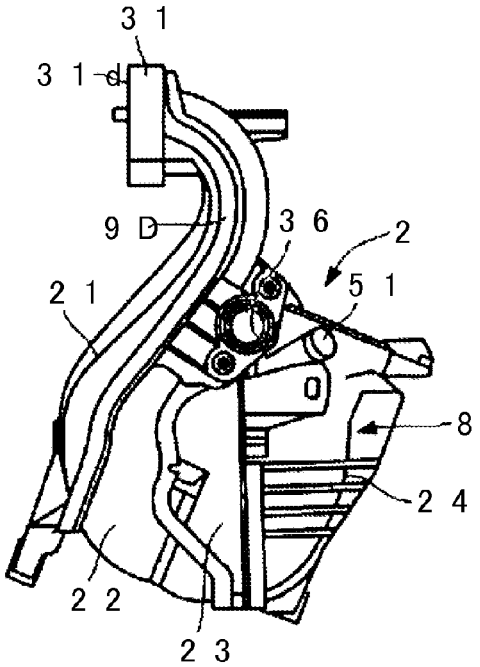

As shown in FIG. 4, the engine 1 according to the present embodiment is longitudinally installed such that the axis of the crankshaft 13, that is, the crank axis, extends in the longitudinal direction of a vehicle 50. The intake manifold 2 is installed on one side face of the engine 1 so as to be located laterally (sideways) with respect to the longitudinal direction of the vehicle 50.

Next, the specific configuration of the intake manifold 2 will be described with reference to FIG. 2, FIG. 3, and FIG. 5 to FIG. 14.

In FIG. 2, FIG. 3, FIG. 5 and FIG. 6, the intake manifold 2 includes a plurality of split pieces. The plurality of split pieces are split into multiple pieces at a side close to the one side face of the engine 1 and a side far from the one side face of the engine 1, and are connected to each other via joint faces.

Specifically, the intake manifold 2 is split into first split branch pipes 21, second split branch pipes 22, an EGR case 23 and a surge tank case 24, each made of resin, in order from the side close to the one side face of the engine 1 toward the far side.

The first split branch pipes 21 are connected to the second split branch pipes 22 by welding or bonding. The second split branch pipes 22 are connected to the EGR case 23 by welding or bonding. The EGR case 23 is connected to the surge tank case 24 by welding or bonding.

In the intake manifold 2 according to the present embodiment, the EGR case 23 and the surge tank case 24 constitute the surge tank 8, and the first split branch pipes 21 and the second split branch pipes 22 constitute the four intake branch pipes 9A to 9D.

Figure 7:
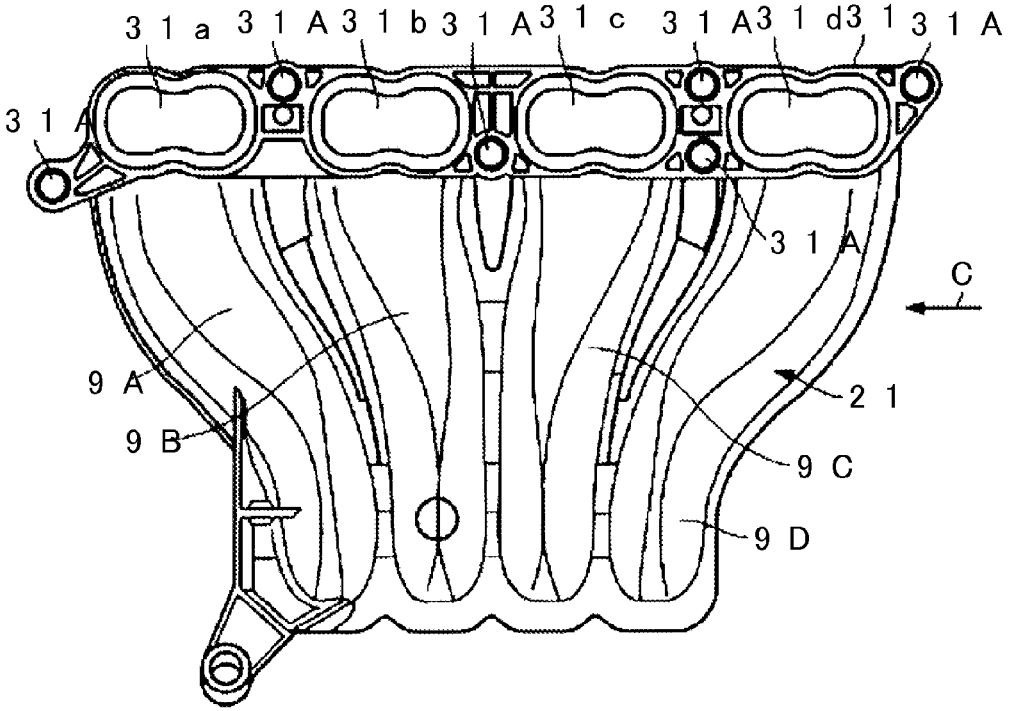
FIG. 7 is a view that shows the embodiment of the intake manifold according to the invention, in which FIG. 7(*a*) is a front view of first split branch pipes and FIG. 7(*b*) is a side view of FIG. 7(*a*) in the direction of C.
Figure 7:
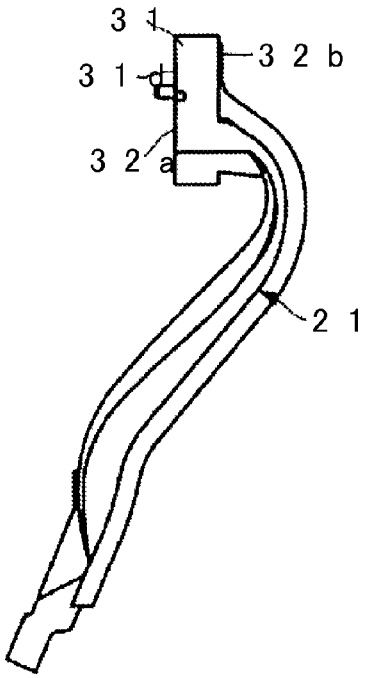
Figure 8:
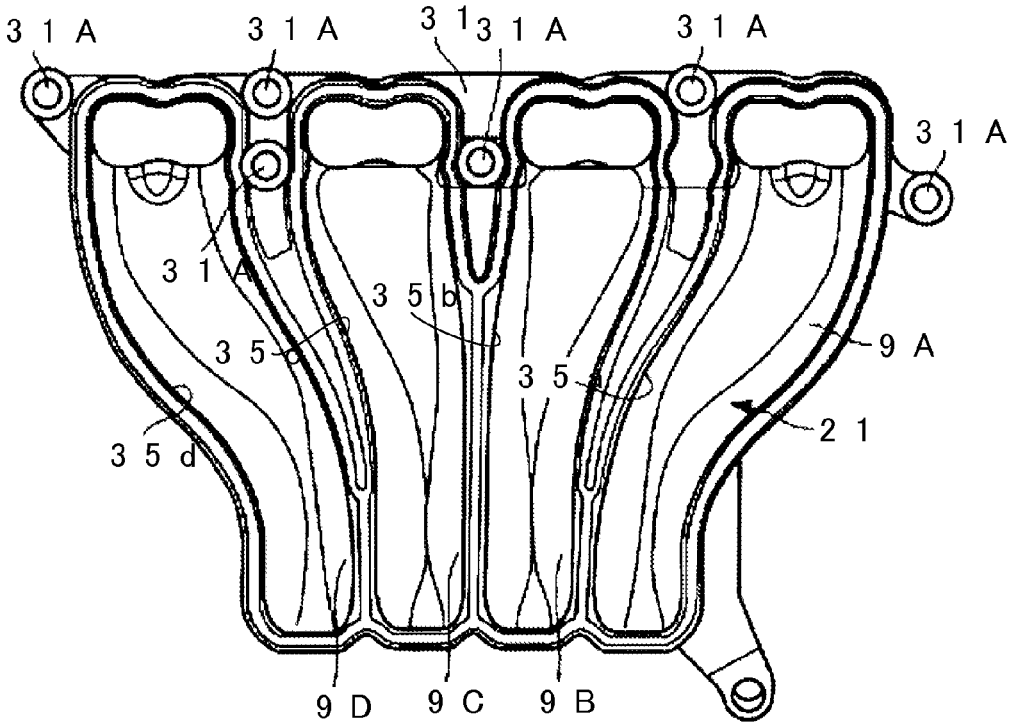
FIG. 8 is a view that shows the embodiment of the intake manifold according to the invention and is a rear view of the first split branch pipes.

As shown in FIG. 7 and FIG. 8, each of the first split branch pipes 21 constitutes one counterpart of any one of the intake branch pipes 9A to 9D. A flange portion 31 that is connected to the cylinder head 1*a* is formed at the distal end of each first split branch pipe 21. Openings 31*a* to 31*d* are respectively formed in the flange portions 31. The openings 31*a* to 31*d* communicate with the intake ports of the cylinder head 1*a*.

A plurality of bolt insertion holes 31A are formed in the flange portions 31. When bolts (not shown) are inserted through the bolt insertion holes 31A and the bolts are screwed to the cylinder head 1*a*, the flange portions 31 are fastened to the cylinder head 1*a*.

Figure 9:
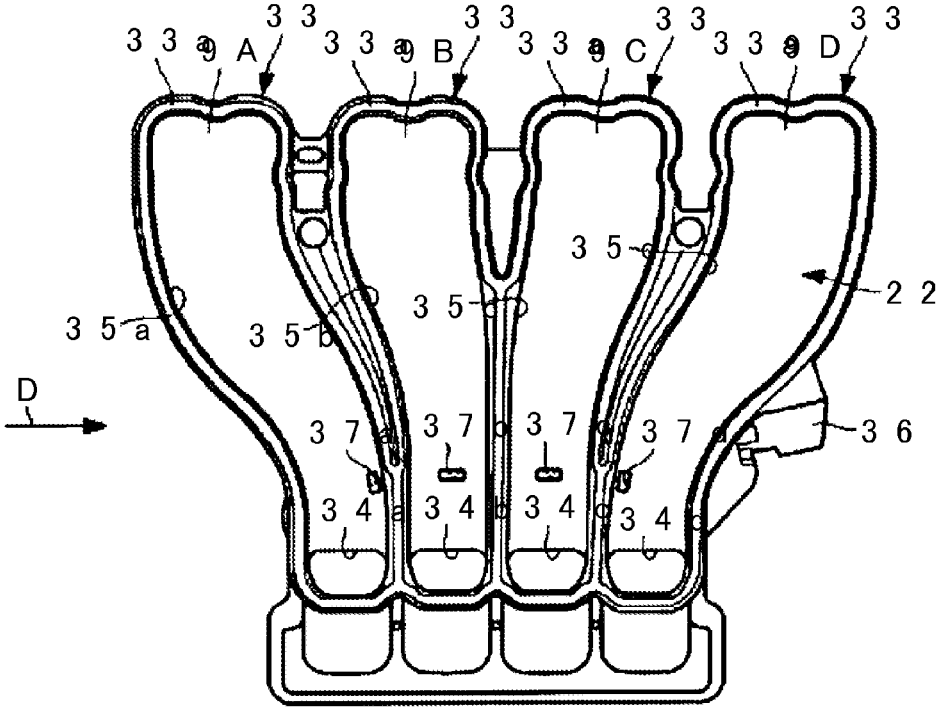
FIG. 9 is a view that shows the embodiment of the intake manifold according to the invention, in which FIG. 9(*a*) is a front view of second split branch pipes and FIG. 9(*b*) is a side view of FIG. 9(*a*) in the direction of D.
Figure 9:
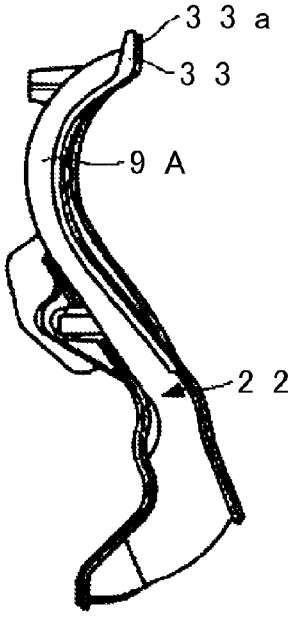
Figure 10:
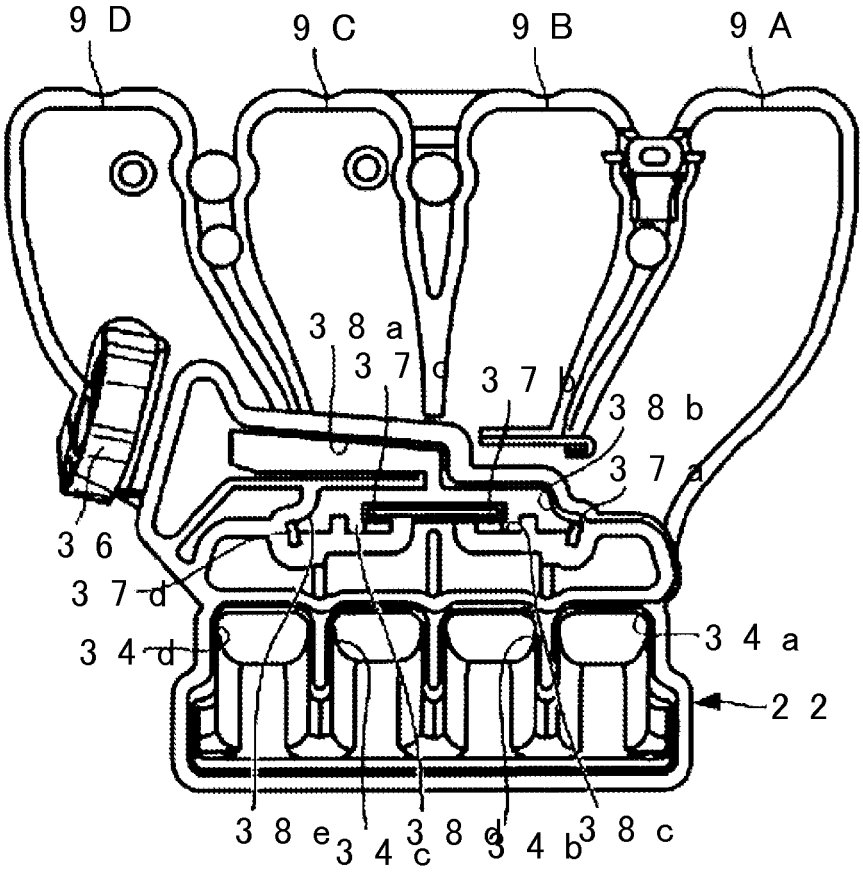
FIG. 10 is a view that shows the embodiment of the intake manifold according to the invention and is a rear view of the second split branch pipes.

As shown in FIG. 9 and FIG. 10, each of the second split branch pipes 22 constitutes the other counterpart of any one of the intake branch pipes 9A to 9D. A plurality of openings 34*a* to 34*d* are respectively formed at the lower portions of the second split branch pipes 22. The openings 34*a* to 34*d* respectively communicate with the radially inner sides of the intake branch pipes 9A to 9D, that is, the delivery passages 35*a* to 35*d* of the intake branch pipes 9A to 9D. The first split branch pipes 21 and the second split branch pipes 22 constitute the intake branch pipes 9A to 9D.

Specifically, as shown in FIG. 8 and FIG. 9, the delivery passages 35*a* to 35*d* are defined by one faces of the first split branch pipes 21 and one faces of the second split branch pipes 22, and the openings 34*a* to 34*d* respectively communicate with the delivery passages 35*a* to 35*d*.

As shown in FIG. 10, an EGR gas introduction portion 36 is provided at the other faces of the second split branch pipes 22. The EGR gas introduction portion 36 is connected to the EGR pipe 15, and EGR gas is introduced from the EGR pipe 15.

Communication holes 37*a* to 37*d* are formed in the second split branch pipes 22. The communication holes 37*a* to 37*d* respectively communicate with the delivery passages 35*a* to 35*d*. A main passage portion 38*a* and delivery passage portions 38*b* to 38*e* are formed at the other faces of the second split branch pipes 22. The main passage portion 38*a* communicates with the EGR gas introduction portion 36. The delivery passage portions 38*b* to 38*e* are branched from the main passage portion 38*a* and are respectively continuous with the communication holes 37*a* to 37*d*.

Figure 11:
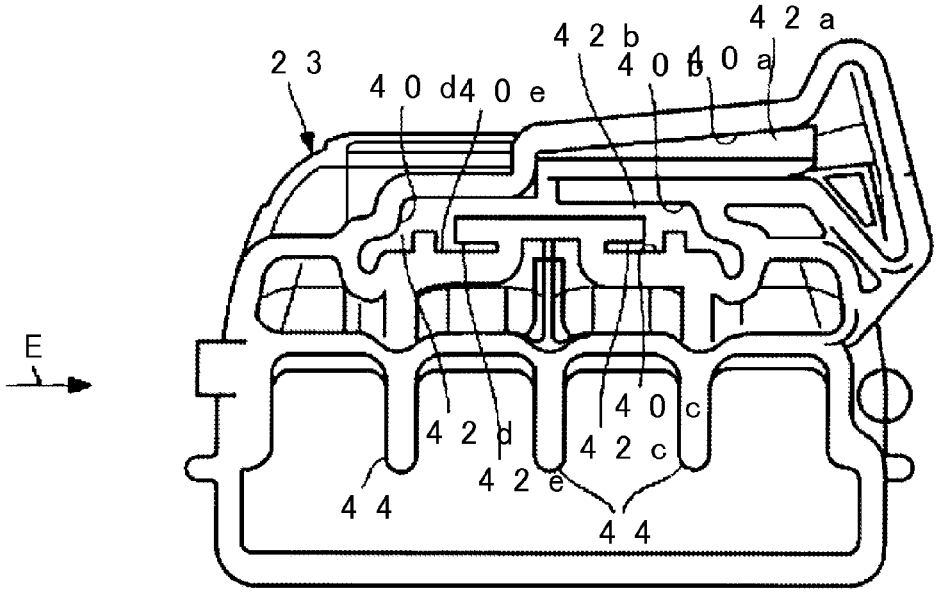
FIG. 11 is a view that shows the embodiment of the intake manifold according to the invention, in which FIG. 11(*a*) is a front view of an EGR case and FIG. 11(*b*) is a side view of FIG. 11(*a*) in the direction of E.
Figure 11:
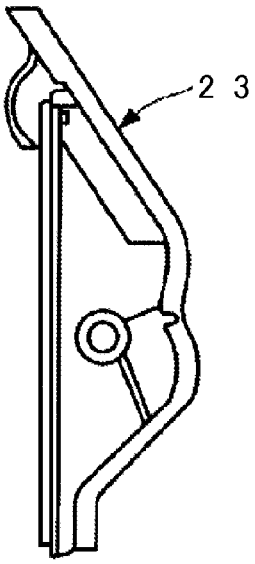

As shown in FIG. 11, a main passage portion 40*a* and delivery passage portions 40*b* to 40*e* are formed at one face of the EGR case 23. The main passage portion 40*a* communicates with the EGR gas introduction portion 36. The delivery passage portions 40*b* to 40*e* are branched from the main passage portion 40*a*.

Thus, in the radially inner portion of the second split branch pipes 22 and the EGR case 23, a main passage 42*a* is defined by the main passage portion 38*a* and the main passage portion 40*a*, and delivery passages 42*b* to 42*e* are respectively defined by the delivery passage portions 38*b* to 38*e* and the delivery passage portions 40*b* to 40*e* (the reference signs of the main passage 42*a* and the delivery passages 42*b* to 42*e* are shown in only FIG. 11(*a*)).

Figure 12:
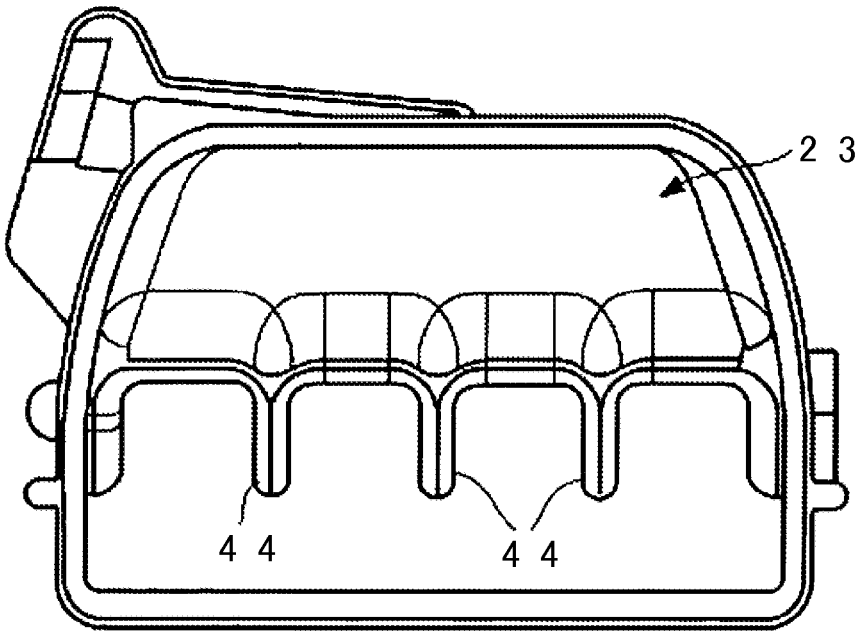
FIG. 12 is a view that shows the embodiment of the intake manifold according to the invention and is a rear view of the EGR case.

As shown in FIG. 11 and FIG. 12, a plurality of ribs 44 are formed below the delivery passage portions 40*b* to 40*e* of the EGR case 23. In the second split branch pipes 22, the ribs 44 each are located between the adjacent openings 31*a* to 31*d* of the second split branch pipes 22, and have the function of a guide for intake air that is introduced into the openings 31*a* to 31*d*.

Figure 13:
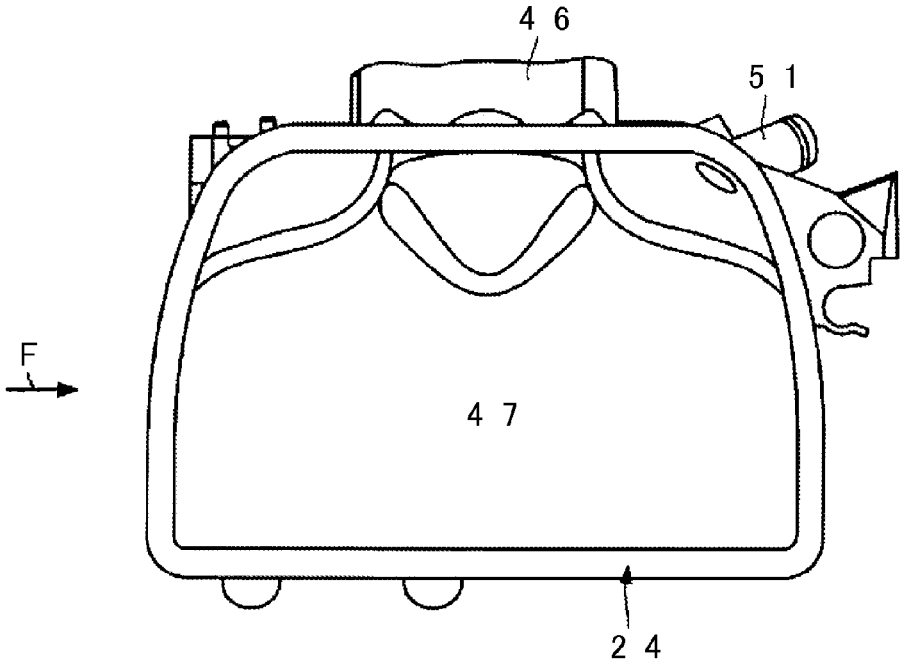
FIG. 13 is a view that shows the embodiment of the intake manifold according to the invention, in which FIG. 13(*a*) is a front view of a surge tank case and FIG. 13(*b*) is a side view of FIG. 13(*a*) in the direction of F.
Figure 13:
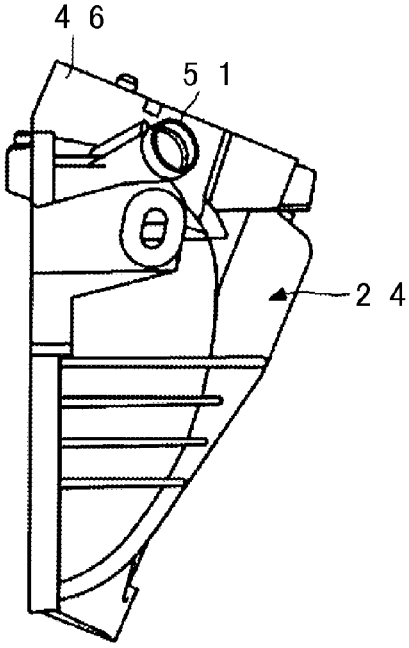
Figure 14:
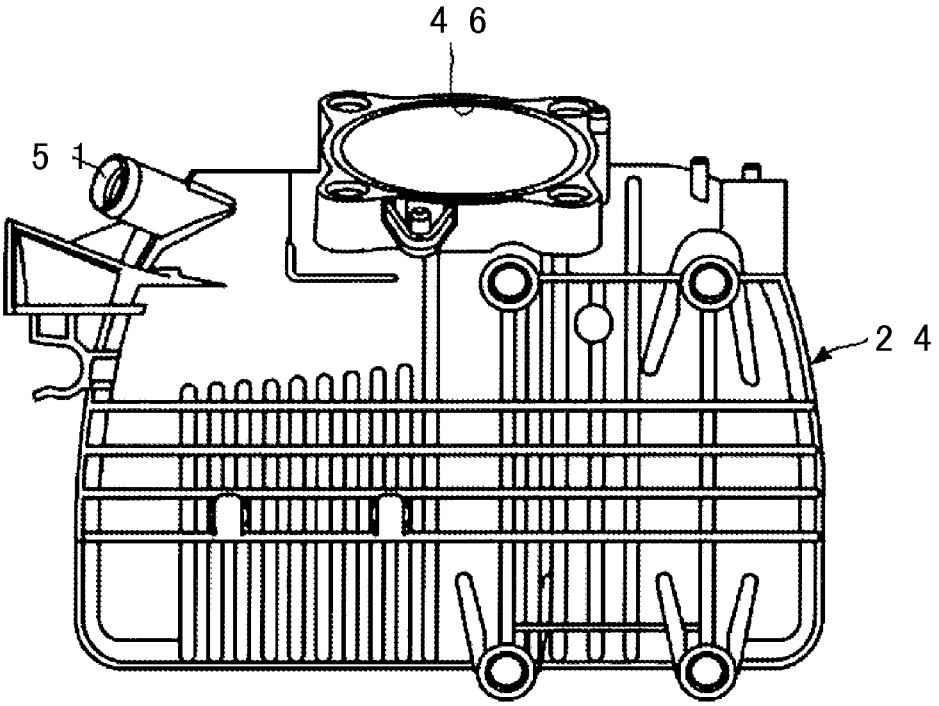
FIG. 14 is a view that shows the embodiment of the intake manifold according to the invention and is a rear view of the surge tank case.

As shown in FIG. 13 and FIG. 14, an intake air introduction portion 46 is provided in the surge tank case 24. The intake air introduction portion 46 is connected to the intake pipe 3, and intake air is introduced into the intake air introduction portion 46 through the intake pipe 3.

In the surge tank case 24, an intake passage 47 is defined between the EGR case 23 and the other face of the surge tank case 24. Intake air is introduced from the intake air introduction portion 46 into the intake passage 47. When intake air is introduced from the intake air introduction portion 46 into the intake passage 47, the intake air is guided by the ribs 44 of the second split branch pipes 22 and is introduced into the openings 31*a* to 31*d* of the second split branch pipes 22. Intake air that is introduced into the openings 31*a* to 31*d* is guided to the combustion chambers 4 of the engine 1 through the delivery passages 35*a* to 35*d* of the intake branch pipes 9 constituted of the first split branch pipes 21 and the second split branch pipes 22.

A purge gas introduction portion 51 is provided in the surge tank case 24, and evaporative fuel evaporated from a fuel tank (not shown) is introduced into the intake passage 47 through the purge gas introduction portion 51. The evaporative fuel is introduced into the combustion chambers 4 of the engine 1 together with intake air from the intake passage 47 through the delivery passages 35*a* to 35*d*.

Figure 15:
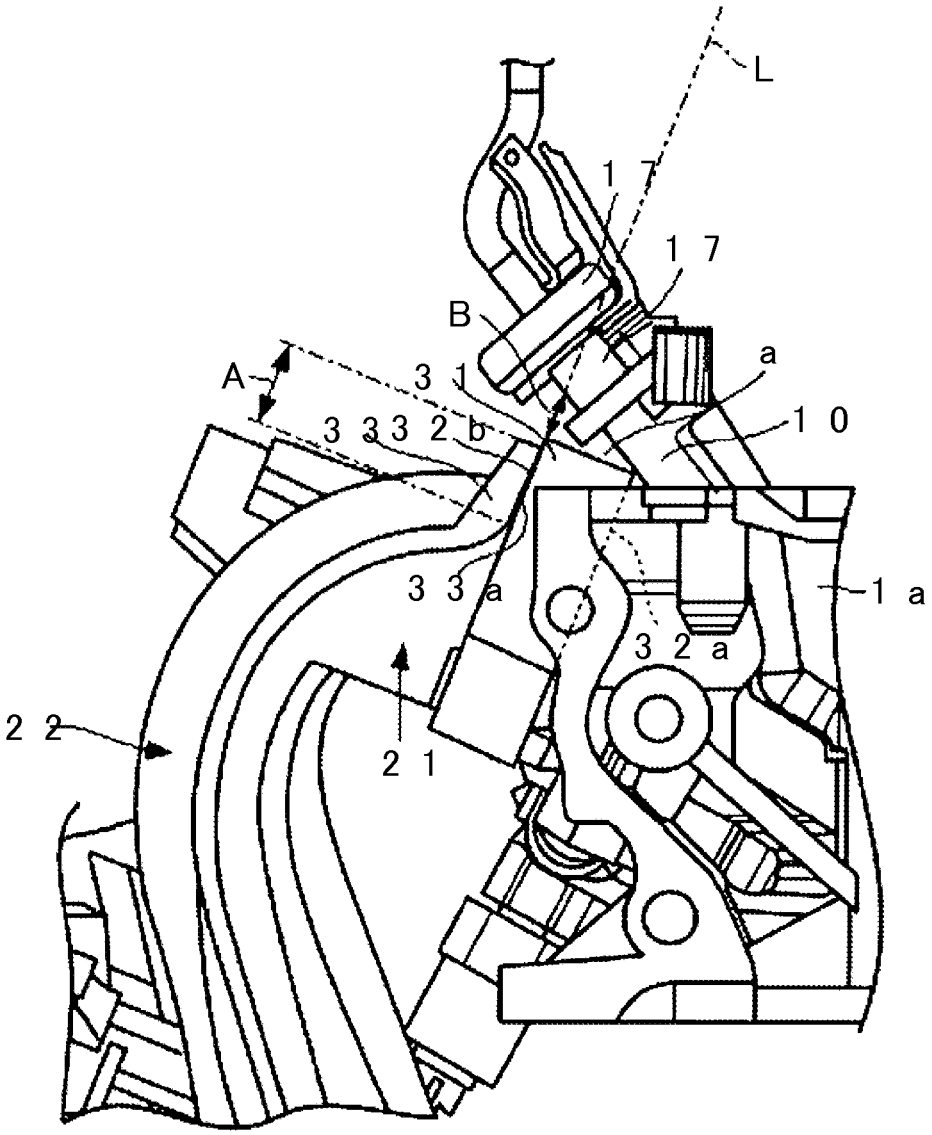
FIG. 15 is a view that shows the embodiment of the intake manifold according to the invention and is an enlarged view around a fuel injection valve.

On the other hand, as shown in FIG. 7 and FIG. 15, the flange portion 31 of each first split branch pipe 21 has a contact face 32*a* at one side face. The contact face 32*a* contacts the one side face of the cylinder head 1*a*. Each flange portion 31 is fastened to the cylinder head 1*a* on the lower side of the corresponding fuel injection valve 10 so as to face the corresponding fuel injection valves 10.

Each flange portion 31 has a joint face 32*b* at the other side face. The joint face 32*b* constitutes a first joint face. The joint face 32*b* is formed in a linear shape.

As shown in FIG. 9 and FIG. 15, a joint portion 33 is formed at the distal end of each second split branch pipe 22, and a joint face 33*a* that constitutes a second joint face is formed at one side face of the joint portion 33. The joint face 33*a* is formed in a linear shape, and the joint face 33*a* of each joint portion 33 is connected to the joint face 32*b* of a corresponding one of the flange portions 31.

As shown in FIG. 15, lines L extended from the joint faces 32*b* of the flange portions 31 and the joint faces 33*a* of the joint portions 33 are set at positions clear of the fuel injection valves 10. That is, the intake manifold 2 according to the present embodiment is connected to the cylinder head 1*a* by connecting the joint faces 32*b* and the joint portions 33 to each other such that the lines L extended from the joint faces 32*b* of the flange portions 31 and the joint faces 33*a* of the joint portions 33 are oriented toward the positions clear of the fuel injection valves 10. The extended lines L are specifically extended lines of joint faces that are formed between the joint faces 32*b* and the joint faces 33*a* when both faces are connected to each other, and are lines extended outward in a direction in which the joint faces 33*a* extend.

Each fuel injection valve 10 is installed on the top face of the cylinder head 1*a* so as to be inclined at a predetermined angle with respect to the top face of the cylinder head 1*a* in order to smoothly supply fuel from the fuel injection valve 10 to the corresponding combustion chamber 4 via the corresponding intake port. Therefore, the space a is defined between the cylinder head 1*a* and each flange portion 31.

Each joint portion 33 is formed such that the length A of the joint face 33*a* in the direction in which the joint face 33*a* extends is longer than a maximum spaced distance B between the corresponding fuel injection valve 10 and the corresponding flange portion 31. Therefore, each joint portion 33 does not enter the space a between the corresponding fuel injection valve 10 and the corresponding flange portion 31.

Next, the operation will be described.

As shown in FIG. 4, the engine 1 is longitudinally installed such that the crank axis extends in the longitudinal direction of the vehicle 50, and the intake manifold 2 is installed on the one side face of the engine 1 so as to be located laterally (sideways) with respect to the longitudinal direction of the vehicle 50.

A bumper reinforcement 48 that constitutes part of a chassis is provided at the front of the vehicle 50. Thus, when a so-called offset collision that one of right and left sides of the vehicle 50 collides with an object X occurs, the bumper reinforcement 48 deforms as indicated by the dashed line and collides with the intake manifold 2.

Depending on a situation at the time of a collision of the vehicle, when such impact force that the bumper reinforcement 48 pushes the intake manifold 2 upward acts on the intake manifold 2, the intake manifold 2 deforms upward as a whole.

Figure 16:
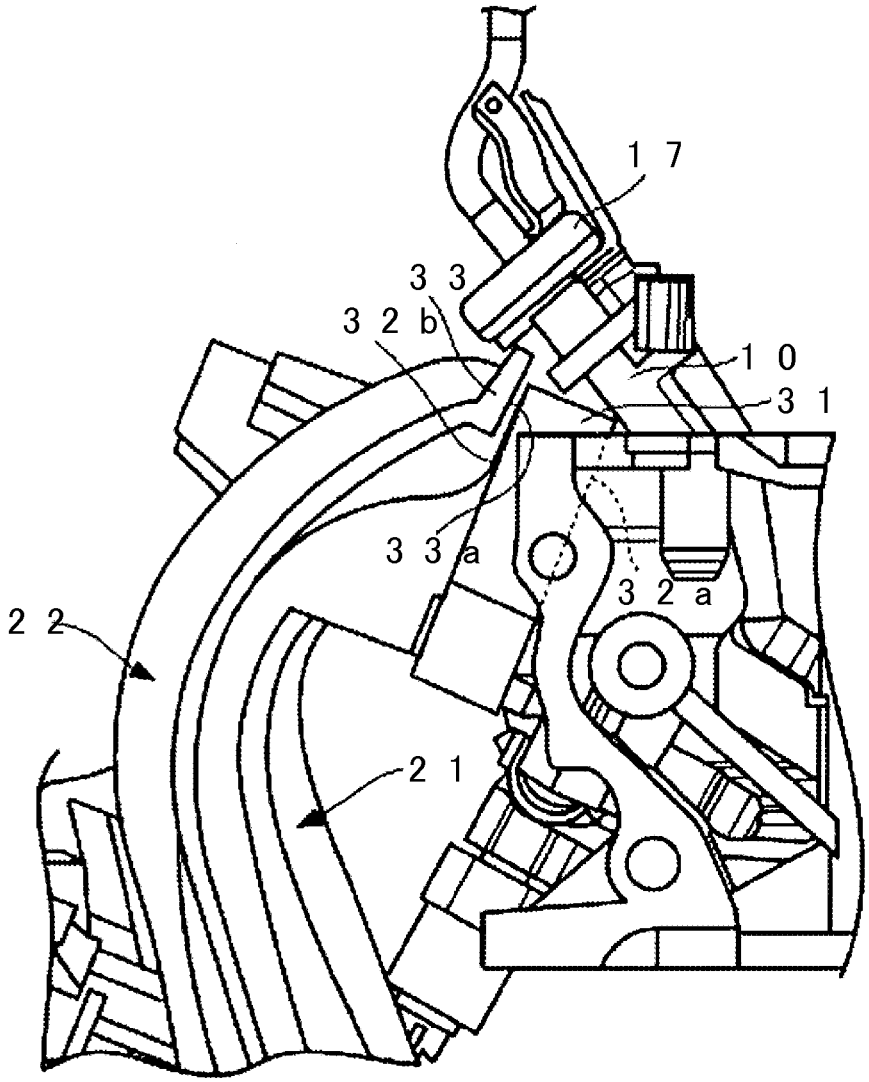
FIG. 16 is a view that shows the embodiment of the intake manifold according to the invention and is an enlarged view around the fuel injection valve, showing a deformed state of the intake manifold at the time of a collision of the vehicle.

Because the flange portions 31 of the first split branch pipes 21 are firmly fastened to the cylinder head 1*a* by bolts, when the intake manifold 2 deforms upward, the linear joint faces 33*a* of the joint portions 33 of the second split branch pipes 22 slide upward with respect to the linear joint faces 32*b* of the flange portions 31 (see FIG. 16).

In the intake manifold 2 according to the present embodiment, the joint faces 32*b* and the joint portions 33 are connected to each other such that the lines L extended from the joint faces 32*b* of the flange portions 31 and the joint faces 33*a* of the joint portions 33 are oriented toward the positions clear of the fuel injection valves 10. Therefore, when the joint faces 33*a* of the joint portions 33 slide upward with respect to the joint faces 32*b* of the flange portions 31, it is possible to suppress a direct collision of the joint portions 33 with the fuel injection valves 10.

Generally, the delivery pipe 17 made of metal is provided so as to extend in the crank axis direction of the engine 1; whereas each of the fuel injection valves 10 has a cylindrical shape and is provided for each cylinder of the engine 1, and has a lower strength than the delivery pipe 17. Therefore, when the joint portions 33 collide with the fuel injection valves 10, there is a concern that large impact acts on the fuel injection valves 10.

In the present embodiment, it is possible to suppress a direct collision of the joint portions 33 with the fuel injection valves 10, so it is possible to suppress interference of the intake manifold 2 with the fuel injection valves 10.

When the joint portions 33 move upward, there is a possibility that any one of the joint portions 33 enters the space a between the cylinder head 1*a* and the corresponding flange portion 31 depending on the behavior of deformation of the intake manifold 2.

In the intake manifold 2 according to the present embodiment, each joint portion 33 is formed such that the length A of the joint face 33*a* in the direction in which the joint face 33*a* extends is longer than the maximum spaced distance B between the corresponding fuel injection valve 10 and the corresponding flange portion 31. Therefore, it is possible to prevent each joint portion 33 from entering the space a between the corresponding fuel injection valve 10 and the corresponding flange portion 31.

Therefore, it is possible to further reliably suppress a collision of the joint portions 33 with the fuel injection valves 10, so it is possible to reliably suppress interference of the intake manifold 2 with the fuel injection valves 10.

In the intake manifold 2 according to the present embodiment, the joint faces 32*b* of the flange portions 31 and the joint faces 33*a* of the joint portions 33 are formed in a linear shape. Therefore, when the joint portions 33 slide upward with respect to the flange portions 31 because of the behavior of the intake manifold 2 at the time of a collision of the vehicle, it is possible to suppress a direct collision of the joint portions 33 with the fuel injection valves 10.

In the intake manifold 2 according to the present embodiment, each flange portion 31 is connected to the cylinder head 1*a* so as to face the corresponding fuel injection valve 10 on the lower side of the corresponding fuel injection valve 10. Therefore, it is possible to connect the flange portions 31 and the joint portions 33 to each other such that the lines L extended from the joint faces 32*b* and the joint faces 33*a* are oriented toward the positions clear of the fuel injection valves 10. Therefore, when the joint portions 33 slide upward with respect to the flange portions 31 because of the behavior of the intake manifold 2 at the time of a collision of the vehicle, it is possible to suppress a direct collision of the joint portions 33 with the fuel injection valves 10.

The intake manifold 2 according to the present embodiment is split into the first split branch pipes 21, the second split branch pipes 22, the EGR case 23 and the surge tank case 24; however, the intake manifold is not limited to this configuration.

For example, the intake manifold may be an intake manifold including a surge tank and intake branch pipes without an EGR passage. That is, as long as an intake manifold including intake branch pipes, each of which is at least split into a first split branch pipe and a second split branch pipe, an intake manifold in any mode may be employed.

As described above, the intake manifold according to the invention has such an advantage that it is possible to suppress interference of the intake manifold with fuel injection valves at the time of a collision of a vehicle. The intake manifold according to the invention is useful as an intake manifold, or the like, that is connected to an internal combustion engine and that introduces intake air into each of cylinders of the internal combustion engine.

DESCRIPTION OF REFERENCE NUMERALS

1 engine, 1*a* cylinder head, 2 intake manifold, 9, 9A to 9D intake branch pipe, 10 fuel injection valve, 21 first split branch pipe, 22 second split branch pipe, 31 flange portion, 32*a* contact face, 32*b* joint face, 33 joint portion, 33*a* joint face

The invention claimed is:

1. An intake manifold mounted on an internal combustion engine in which fuel injection valves are installed so as to be located near one side face of a cylinder head on a top face of the cylinder head, the intake manifold being connected to the one side face of the cylinder head so as to face the fuel injection valves, the intake manifold comprising:

a plurality of intake branch pipes made of resin, the plurality of intake branch pipes being configured to introduce intake air into corresponding intake ports of the cylinder head, each of the intake branch pipes including a first split branch pipe and a second split branch pipe, the second split branch pipe being connected to the first split branch pipe;

wherein each first split branch pipe includes a flange portion at a distal end of the first split branch pipe, each flange portion has a contact face at one side face of the flange portion, each contact face contacts the cylinder head, each flange portion includes a first joint face at the other side face of the flange portion, each flange portion is configured to be connected to the cylinder head, each second split branch pipe includes a joint portion at a distal end of the second split branch pipe, each joint portion has a second joint face that is connected to a corresponding one of the first joint faces, the flange portions and the joint portions are configured to be connected to the cylinder head such that lines extended from the first joint faces and the second joint faces are oriented toward positions clear of the fuel injection valves, and each joint portion is formed such that a length of the second joint face in a direction in which the second joint face extends is longer than a maximum spaced distance between the corresponding fuel injection valve and the corresponding flange portion.

2. The intake manifold according to claim 1, wherein the first joint faces and the second joint faces are formed in a linear shape.

3. The intake manifold according to claim 1, wherein each flange portion is connected to the cylinder head so as to face the corresponding fuel injection valve on a lower side of the corresponding fuel injection valve.

* * * * *